US011330880B2

(12) United States Patent
Higuchi et al.

(10) Patent No.: US 11,330,880 B2
(45) Date of Patent: May 17, 2022

(54) SELF-STANDING HOUSING BODY

(71) Applicant: OSAKA CLIP co., LTD, Osaka (JP)

(72) Inventors: Tomoyuki Higuchi, Osaka (JP); Kazuo Itoi, Osaka (JP)

(73) Assignee: OSAKA CLIP co., LTD, Osaka (JP)

( * ) Notice: Subject to any disclaimer, the term of this patent is extended or adjusted under 35 U.S.C. 154(b) by 255 days.

(21) Appl. No.: 16/615,025

(22) PCT Filed: May 10, 2018

(86) PCT No.: PCT/JP2018/018116
§ 371 (c)(1),
(2) Date: Nov. 19, 2019

(87) PCT Pub. No.: WO2018/216488
PCT Pub. Date: Nov. 29, 2018

(65) Prior Publication Data

US 2020/0196724 A1 Jun. 25, 2020

(30) Foreign Application Priority Data

May 24, 2017 (JP) ..... JP2017-103135

(51) Int. Cl.
*A45C 11/34* (2006.01)
*A45C 13/00* (2006.01)
*B43K 23/00* (2006.01)

(52) U.S. Cl.
CPC ..... *A45C 11/34* (2013.01); *A45C 13/00* (2013.01); *B43K 23/00* (2013.01)

(58) Field of Classification Search
CPC ..... A45C 11/34; A45C 11/008; A45C 13/00; A45C 13/02; A45C 3/00; B43K 23/00; B65D 59/04

(Continued)

(56) References Cited

U.S. PATENT DOCUMENTS 3,884,351 A * 5/1975 James ..... A47B 63/02 206/225
4,736,838 A * 4/1988 Nakata ..... A45C 11/34 206/214

(Continued)

FOREIGN PATENT DOCUMENTS

CN 101163625 A 4/2008
CN 202225651 U 5/2012

(Continued)

OTHER PUBLICATIONS

International Search Report dated Jul. 17, 2018 filed in PCT/JP2018/018116.

(Continued)

*Primary Examiner* — King M Chu
(74) *Attorney, Agent, or Firm* — Rankin, Hill & Clark LLP

(57) ABSTRACT

The present invention proposes a self-standing housing body solving a typical program and stably standing as a penholder. Specifically, the self-standing housing body according to the present invention is a self-standing housing body including a housing portion having a main housing space surrounded by a bottom surface and side surfaces standing from the bottom surface, and a lid portion having a sub-housing space surrounded by an upper surface and side surfaces standing from the upper surface. An upper side of one side surface of the housing portion and a lower side of one side surface of the lid portion form a joint portion, and about the joint portion as a rotation axis, the lid portion is rotatably joined to the housing portion. When the lid portion is rotated approximately 180° relative to the housing portion and the side surface of the lid portion substantially contacts the side surface of the housing portion, the upper surface of the lid portion and the bottom surface of the housing portion are (Continued)

substantially flush with each other. An upper end portion of the side surface of the housing portion does not reach the upper surface.

5 Claims, 8 Drawing Sheets

(58) Field of Classification Search
USPC ..... 206/575, 746, 214, 45.2, 747
See application file for complete search history.

(56) References Cited

U.S. PATENT DOCUMENTS

| | | | | |
|---|---|---|---|---|
| 5,025,928 | A * | 6/1991 | Orosy | A45C 11/008 206/581 |
| 2005/0092648 | A1* | 5/2005 | Jin | A45C 11/34 206/575 |
| 2009/0041395 | A1 | 2/2009 | Bossel et al. | |
| 2017/0013947 | A1 | 1/2017 | Rowe | |

FOREIGN PATENT DOCUMENTS

| | | | |
|---|---|---|---|
| CN | 203234195 | U | 10/2013 |
| CN | 203441156 | U | 2/2014 |
| CN | 203692773 | U | 7/2014 |
| JP | S61181785 | U | 11/1986 |
| JP | 2002320512 | A | 11/2002 |
| JP | 2002320513 | A | 11/2002 |
| JP | 2003-259908 | A | 9/2003 |
| JP | 2010162109 | A | 7/2010 |
| JP | 2017-56125 | A | 3/2017 |
| JP | 6224875 | B1 | 11/2017 |
| JP | 2017200570 | A | 11/2017 |

OTHER PUBLICATIONS

Chinese Office Action (CNOA) dated Oct. 12, 2020 for the corresponding Chinese Patent Application No. 201880033161.7.
Japanese Office Action (JPOA) dated Apr. 2, 2020 for the corresponding Japanese Patent Application No. 2019-519562.

* cited by examiner (a)

(b)

SELF-STANDING HOUSING BODY

TECHNICAL FIELD

The present invention relates to a housing body typified by a pen case for housing a writing material such as a pencil, and specifically relates to a self-standing housing body.

BACKGROUND ART

A pen case configured to house a writing material such as a pencil and configured standable as in a penholder has been proposed.

For example, a pen case has been proposed, which is configured such that a case body is bent in response to forcible bending force when an opening/closing unit is brought into a closed position and is opened at a predetermined angle when the opening/closing unit is brought into an open position and is therefore configured so that the pen case can be, without the operation of expanding the pen case with a hand, utilized as a penholder only by cancellation of a closed state of the case body (e.g., Patent Literature 1).

Moreover, a pen case has been proposed, which is configured such that a case body is relatively movable in a length changing direction so that one end side of a writing material can be exposed to the outside of the case body when the length of the case body is shortened with an outlet/inlet port on one end side of the case body in a longitudinal direction being opened and is configured self-standable by a placement portion so that a writing material case can be utilized as a penholder (e.g., Patent Literature 2).

Further, a container usable not only as a container tray of a small object such as a writing material or a cosmetic item but also as a container stand has been proposed. This container is a container used for housing the object in two postures including a first posture (a horizontal posture) as a pen tray and a second posture (a vertical posture) as a pen stand (e.g., Patent Literature 3). The container includes a body portion 100 having a first bottom portion 101 forming a bottom on which the container self-stands in the first posture, a second bottom portion 102 forming a bottom on which the container self-stands in the second posture and extending across the first bottom portion 101, and an opening 103 in which a portion of the first bottom portion 101 including an end portion opposite to a second bottom portion 102 side opens to an opposite side of a first bottom portion 101 side; and a lid portion 104 configured to open/close the opening 103. The opening 103 is an opening common to the first posture and the second posture.

In addition, a writing material case has been also proposed (e.g., Patent Literature 4). The writing material case is a writing material case configured in an elongated box shape in a closed state of a fastener such that a first housing space of a writing material is formed inside and configured usable in the form of a stand in an open state of the fastener. The writing material case includes a bottom portion and a top portion facing each other in a longitudinal direction of the writing material case in the closed state of the fastener, a front portion and a back portion forming the first housing space in a plane perpendicular to the longitudinal direction in the closed state of the fastener and facing each other in a first direction, and a first side portion and a second side portion facing each other in a second direction perpendicular to the first direction. The fastener is, by way of the first side portion and the top portion, formed from a first spot between a center portion of the first side portion in the longitudinal direction and a bottom-portion-side end portion of the first side portion to a second spot between a center portion of the second side portion in the longitudinal direction and a bottom-portion-side end portion of the second side portion. In the open state of the fastener, the front portion is bendable about a bending region of a center portion in the longitudinal direction. The writing material case can be used in the form of the stand in such a manner that the top portion and the bottom portion contact a mount surface in a state in which the front portion is bent, and can be used in a lying form in such a manner that the back portion contacts the mount surface in a state in which the front portion is bent. The fastener is provided along a back-portion-side edge portion at the top portion. The top portion includes a metal plate as a core.

CITATION LIST

Patent Literature

PATENT LITERATURE 1: JP-A-2002-320513
PATENT LITERATURE 2: JP-A-2002-320512
PATENT LITERATURE 3: JP-A-2017-200570
PATENT LITERATURE 4: Japanese Patent No. 6224875

SUMMARY OF THE INVENTION

Problems to be Solved by the Invention

However, in the configuration disclosed in Patent Literature 1, when the opening/closing unit is at the open position, many writing materials and the like. can be housed. However, a housing capacity significantly decreases when the opening/closing unit is at the closed position. For this reason, the case cannot be closed with many writing materials and the like. being housed. Moreover, even when the opening/closing unit is at the open position, an opening area is small. For this reason, there is a problem that it is difficult to take out a small object such as an eraser.

In the configuration disclosed in Patent Literature 2, a complicated mechanism configured to change the length of the case body is necessary, and for this reason, there is a problem that a housing capacity is smaller with respect to a volume. Moreover, when the length of the case body is changed, there is a risk that a storage object comes out of the case due to the momentum of such a change.

In the configuration disclosed in Patent Literature 3, a locking portion 1082 reaches, as illustrated in FIG. 2, a left end surface of the lid portion 104 as viewed in FIG. 2. Thus, in the first posture (FIG. 4) as the pen stand, stiffness of a standing portion of the lid portion 104 is low, a self-standing posture as the pen stand become unstable, and falling and tilting are easily caused.

Moreover, in the first posture as the pen stand, the lid portion 104 cannot be utilized as a housing portion.

Further, there are various problems that when the locking portion 1082 is opened/closed, an opening/closing distance is long and opening/closing requires great care.

In the configuration disclosed in Patent Literature 4, there are problems similar to those of the container disclosed in Patent Literature 3 as described above. Specifically, in a configuration in which the fastener illustrated in FIGS. 18 and 19 passes through the inside of the top portion, these problems become more prominent.

The present invention proposes a self-standing housing body such as a pencase, a makeup pouch, and a laptop computer case that can solve the above-described problems and is configured more stably standable.

Solution to the Problems

To solve the above-described problems, azo self-standing housing body described in claim 1 of the present invention includes a housing portion having a main housing space surrounded by a bottom surface and side surfaces standing from the bottom surface, and a lid portion having a sub-housing space surrounded by an upper surface and side surfaces standing from the upper surface, an opening/closing unit configured to detachably open/close the housing portion and the lid portion, in which a height position of an end portion of the opening/closing unit is provided closer to the bottom surface than a height position of the joint portion is to part of an upper end portion of the side surface of the housing portion and part of a lower end portion of the side surface of the lid portion form a joint portion, and about the joint portion as a substantially rotation axis, the lid portion is rotatably joined to the housing portion, when the lid portion is rotated approximately 180° relative to the housing portion and the side surface of the lid portion substantially contacts the side surface of the housing portion, the upper surface of the lid portion and the bottom surface of the housing portion are substantially flush with each other, and the upper end portion of the side surface of the housing portion does not reach the upper surface.

In addition, a self-standing housing body described in claim 1 is the self-standing housing body described in claim 1, wherein at the housing portion, a bendable portion allowing an upper portion of a side surface facing a side surface having the joint portion to bend to a direction of the bottom surface.

In addition, a self-standing housing body described in claim 3 is the self-standing housing body described in claim 1 or 2, further comprising:

a side portion fixing unit configured to detachably fix the side surface of the lid portion and the side surface of the housing portion contacting each other when the lid portion is rotated approximately 180° relative to the housing portion.

In addition, a self-standing housing body described in claim 4 is the self-standing housing body described in claim 3, wherein the side portion fixing unit uses magnetic interaction.

In addition, a self-standing housing body described in claim 5 is the self-standing housing body described in claims 1 to 4, wherein the self-standing housing body is a self-standing pen case.

Effects of the Invention

The self-standing housing body according to the present invention is configured as described above, and therefore, the following many advantageous effects of the invention are provided.

First, a housing capacity does not change between a state in which the self-standing housing body is closed and a state in which the pen case is opened in a standing state, and therefore, even when many writing materials are housed in the opened standing state, the self-standing housing body can be closed in such a state and be carried.

Moreover, a lid opening/closing mechanism similar to that of a typical pen case is employed. Thus, a complicated mechanism is not necessary, a manufacturing cost does not greatly increase, and the housing capacity does not decrease due to the opening/closing mechanism.

Further, a placement area is doubled in a state in which the self-standing housing body is opened in the standing state, and therefore, the pen case can be used as an extremely-stable standing penholder. In recent years, a high-texture pen case providing a tender impression and formed by fabric sewing has been popular. Even when such a soft material is used, the placement area is broad, and therefore, stable standing can be realized.

In addition, the height position of the joint portion between the housing portion and the lid portion is at the substantially center position of the height when the self-standing housing body is closed. The lid portion is, about the joint portion as the axis, rotated relative to the housing portion and stands, and therefore, the height of the side surface of the housing portion including the joint portion is, in the standing state, at the substantially-half position of the height in the closed state. Thus, a storage object is easily taken out.

Specifically, when the height position of an end portion of an opening/closing unit is provided closer to the bottom surface than the height position of the joint portion is to, the height of the side surface of the housing portion including the joint portion becomes much lower, and the storage object is more easily taken out. Moreover, the storage object is less caught by the lid portion upon opening/closing of the lid portion, and opening/closing of the lid portion is smoothly performed.

Further, the lid portion can be separately used as a housing portion in the standing state, and therefore, use application is greatly expanded to various purposes. For example, a small object which is difficult to be taken out, such as an eraser or a clip, can be placed in the housing portion of the lid portion, and the housing portion of the lid portion can be utilized as a smartphone stand, and a tablet PC stand.

As described above, the lid portion can be separately used as the housing portion because it is configured such that the upper end portion of the side surface of the housing portion does not reach the upper surface. With this configuration, the lid portion is in the form of a container in the standing state, and the small object and the like can be housed.

Moreover, since the lid portion is in the form of the container, stiffness of a standing portion of the lid portion is high, a self-standing posture as a pen stand is stabilized, and falling and tilting are less caused.

Further, upon opening/closing, an opening/closing distance is short, and opening/closing operation is promptly performed.

In addition, a pocket for the small object can be provided on the inside of the lid portion, and therefore, the small object which is difficult to be taken out, such as the eraser or the clip, can be more easily taken out in the standing state.

Moreover, the side portion fixing unit such as a magnet allows, in the closed state, storage of the self-standing housing body with the pen case being attached to, e.g., a wall surface of a steel locker. For example, a narrow space of the locker can be effectively utilized.

Similar advantageous effects are also provided when the present invention is used as a self-standing makeup pouch.

Specifically, it is convenient upon makeup at a narrow space such as a makeup room outside a home. The self-standing makeup pouch is used, and therefore, easy placement even in a narrow space is realized and an elongated object such as a brush, an eyelash liner, or an eye shadow is easily taken out. Moreover, the lid portion can be separately used as the housing portion, and therefore, functional use for makeup, such as standing of a small mirror or placement of a short lip stick or a short chapstick, can be realized.

DESCRIPTION OF EMBODIMENTS

The present invention relates to a self-standing housing body such as a self-standing pen case and a self-standing makeup pouch having a similar configuration. In embodiments below, embodiments in the case of use as the self-standing pen case will be described. However, a similar configuration and similar operation are also employed in the case of use as the self-standing makeup pouch. That is, a self-standing housing body according to the present invention as described below is used in a standing state so that the pen case can be also used as a penholder. Similarly, a makeup kit can be carried upon use as the makeup pouch, and the makeup pouch can be also used as a makeup stand upon use in the standing state.

First Embodiment

Hereinafter, an embodiment of the self-standing pen case according to the present invention will be described with reference to the figures. Note that the embodiment below is one optimal example of the present invention, and is not intended to limit the present invention to such an example.

<Configuration of Self-Standing Pen Case>

First, a main configuration of the self-standing pen case will be described with reference to FIGS. 1 and 2.

Figure 1:
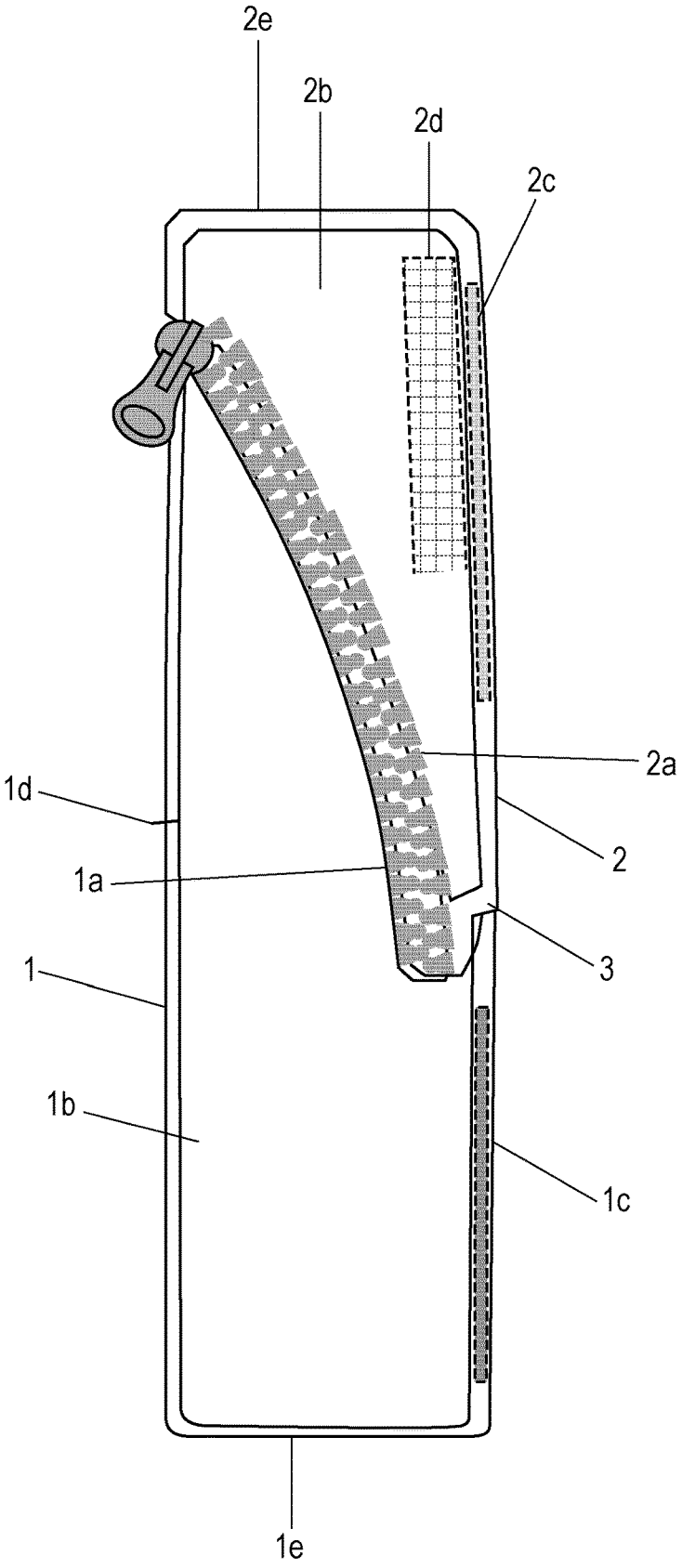
FIG. 1 illustrates a side view in a state in which a lid of a self-standing housing body of the present invention is closed.

FIG. 1 illustrates a side view in a state in which a lid of the self-standing pen case is closed.

Figure 2:
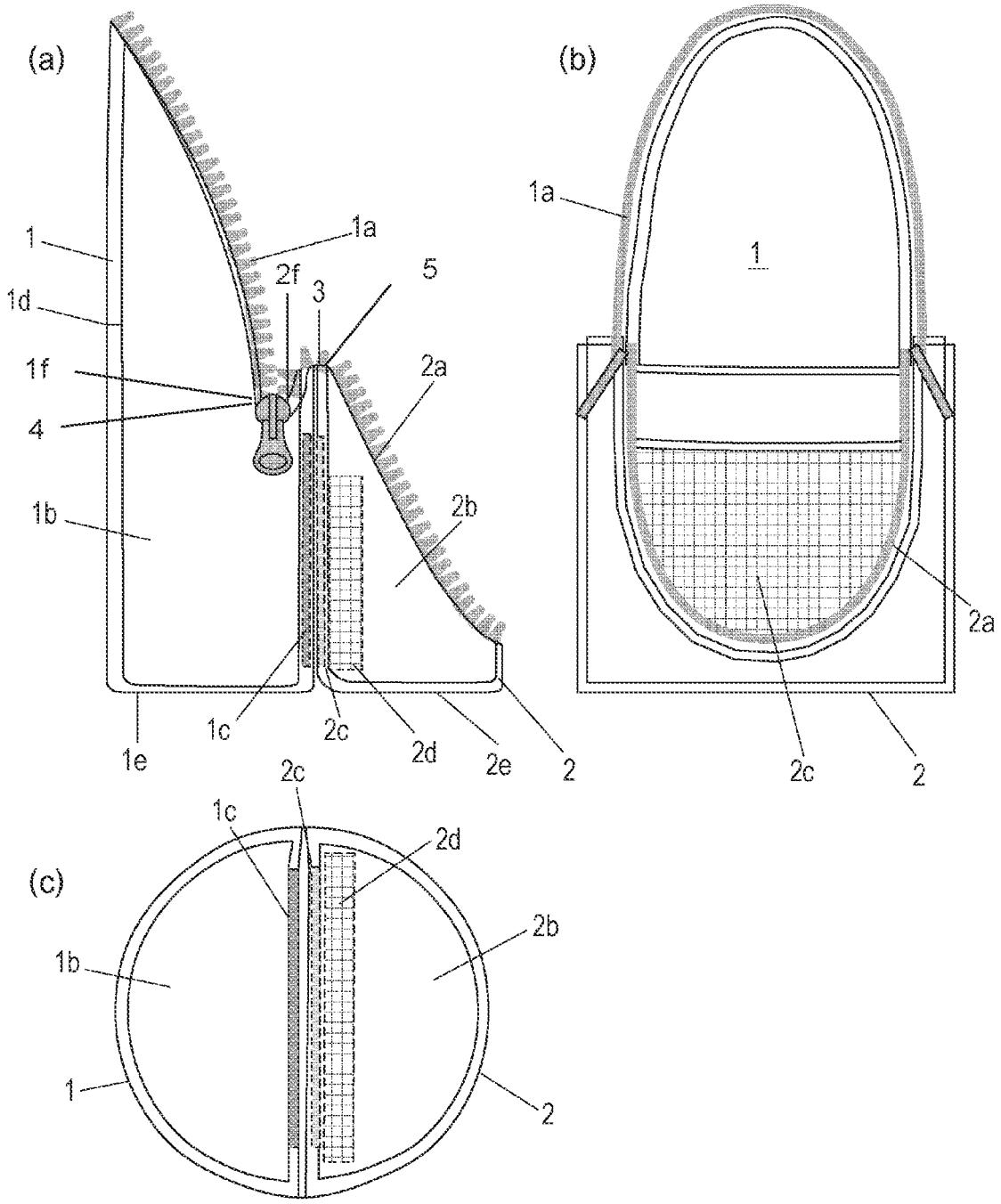
FIG. 2 illustrates (a) a side view, (b) a front view, and (c) a bottom view in a state in which the lid of the self-standing housing body of the present invention is opened in a standing state.

FIG. 2 illustrates (a) a side view, (b) a front view, and (c) a bottom view in a state in which the self-standing pen case stands with the lid of the self-standing pen case being opened.

The self-standing pen case mainly includes a housing portion 1 having a main housing space 1*b* surrounded by a bottom surface 1*e* and side surfaces standing from the bottom surface 1*e*, and a lid portion 2 having a sub-housing space 2*b* surrounded by an upper surface 2*e* and side surfaces standing from the upper surface 2*e*.

Moreover, as illustrated in FIG. 2, part of an upper end portion of the side surface of the housing portion 1 and part of a lower end portion of the side surface of the lid portion 2 form a joint portion 3, and about the joint portion 3 as a substantially rotation axis, the lid portion 2 is rotatably joined to the housing portion 1. It is a great feature of the present invention that when the lid portion 2 is rotated approximately 180° relative to the housing portion 1 and the side surface of the lid portion 2 substantially contacts the side surface of the housing portion 1, an upper surface of the lid portion 2 and a bottom surface of the housing portion 1 are substantially flush with each other. Moreover, it is also a great feature of the present invention that the upper end portion of the side surface of the housing portion does not reach the above-described upper surface.

Note that the joint portion 3 may be configured such that part of the upper end portion of the side surface of the housing portion 1 and part of the lower end portion of the side surface of the lid portion 2 are directly joined to each other or may be configured such that these portions are indirectly joined to each other through a flexible material such as a band tape. Thus, the phrasing that "part of the upper end portion of the side surface of the housing portion 1 and part of the lower end portion of the side surface of the lid portion 2 form the joint portion 3" is a concept including not only a case where part of the upper end portion of the side surface of the housing portion 1 and part of the lower end portion of the side surface of the lid portion 2 are directly joined to each other to form the joint portion 3 but also a case where these portions are indirectly joined to each other to form the joint portion 3.

In a case where the housing portion 1 and the lid portion 2 are made of the flexible material or a case where the housing portion 1 and the lid portion 2 are indirectly joined to each other through the flexible material such as the band tape, the joint portion 3 is not taken as one definite rotation axis. That is, the lid portion 2 is rotatable relative to the housing portion 1 about the vicinity of the joint portion 3 as a "flexible" rotation axis (=the substantially rotation axis). The above-described phrasing that "about the joint portion 3 as the substantially rotation axis, the lid portion 2 is rotatably joined to the housing portion 1" is a concept also including such a configuration.

Hard resin or foam resin may be used as the materials forming the housing portion 1 and the lid portion 2. However, considering texture and friendliness to people, a soft material configuration is preferably employed such that an elastomer material is used and sewn fabric is used as a cover. Alternatively, synthetic rubber may be used as a core, and polyester or nylon may be used as a surface cloth or a back cloth. In these cases, fasteners are optimal as opening/closing units 1*a*, 2*a* of the housing portion 1 and the lid portion 2.

Note that as illustrated in FIG. 2, the height positions 4 of end portions 1*f*, 2*f* of the opening/closing units 1*a*, 2*a* are preferably provided closer to the bottom surface 1*e* than the height position 5 of the joint portion 3 is to. With this configuration, when the pen case is opened in a standing state, the height of the vicinity of the joint portion 3 of the housing portion 1 is low, and therefore, a storage object is more easily taken out.

Moreover, side portion fixing units 1*c*, 2*c* configured to detachably fix the side surface of the lid portion 2 and the side surface of the housing portion 1 contacting each other when the lid portion 2 is rotated approximately 180° relative to the housing portion 1 are preferably provided. For example, a configuration in which one of the side portion fixing units 1*c*, 2*c* is a permanent magnet sheet and the other one of the side portion fixing units 1*c*, 2*c* is a ferromagnetic sheet is one example. As described above, when the pen case is opened, the housing portion 1 and the lid portion 2 are firmly fixed to each other by means of magnetic interaction, and therefore, the pen case can stably stand. Note that, e.g., a PP sheet plate including a permanent magnet may be used instead of the permanent magnet sheet, or a PP sheet plate including a steel plate piece may be used instead of the ferromagnetic sheet.

Note that, e.g., a surface fastener may be used other than the magnetic interaction. That is, as long as a detachable method for firmly fixing the housing portion 1 and the lid portion 2 is employed, any method may be employed in a basic way.

Further, at the housing portion 1, a bendable portion 1*d* allowing an upper portion of the side surface facing the side surface having the joint portion 3 to bend in the direction of the bottom surface 1*e* may be provided. A reason why the bendable portion 1*d* is provided will be described in a later-described use example.

In addition, a pocket 2*d* for housing a small object in the sub-housing space 2*b* as the inside of the lid portion 2 may be provided. It is also one of the features of the present invention that the pocket 2*d* can be provided on an inner wall of the lid portion 2. The pocket 2*d* is a pocket for housing the small object such as an eraser or a clip, and is produced by, e.g., sewing of fabric. For example, a surface fastener may be provided at an inlet of the pocket 2*d* to prevent the housed small object from dropping from the pocket 2*d* when the lid portion 2 is closed. Alternatively, the pocket 2*d* itself may be made of an elastic material, and the small object may be sandwiched by elastic force.

<Use Example of Self-Standing Pen Case>

Figure 3:
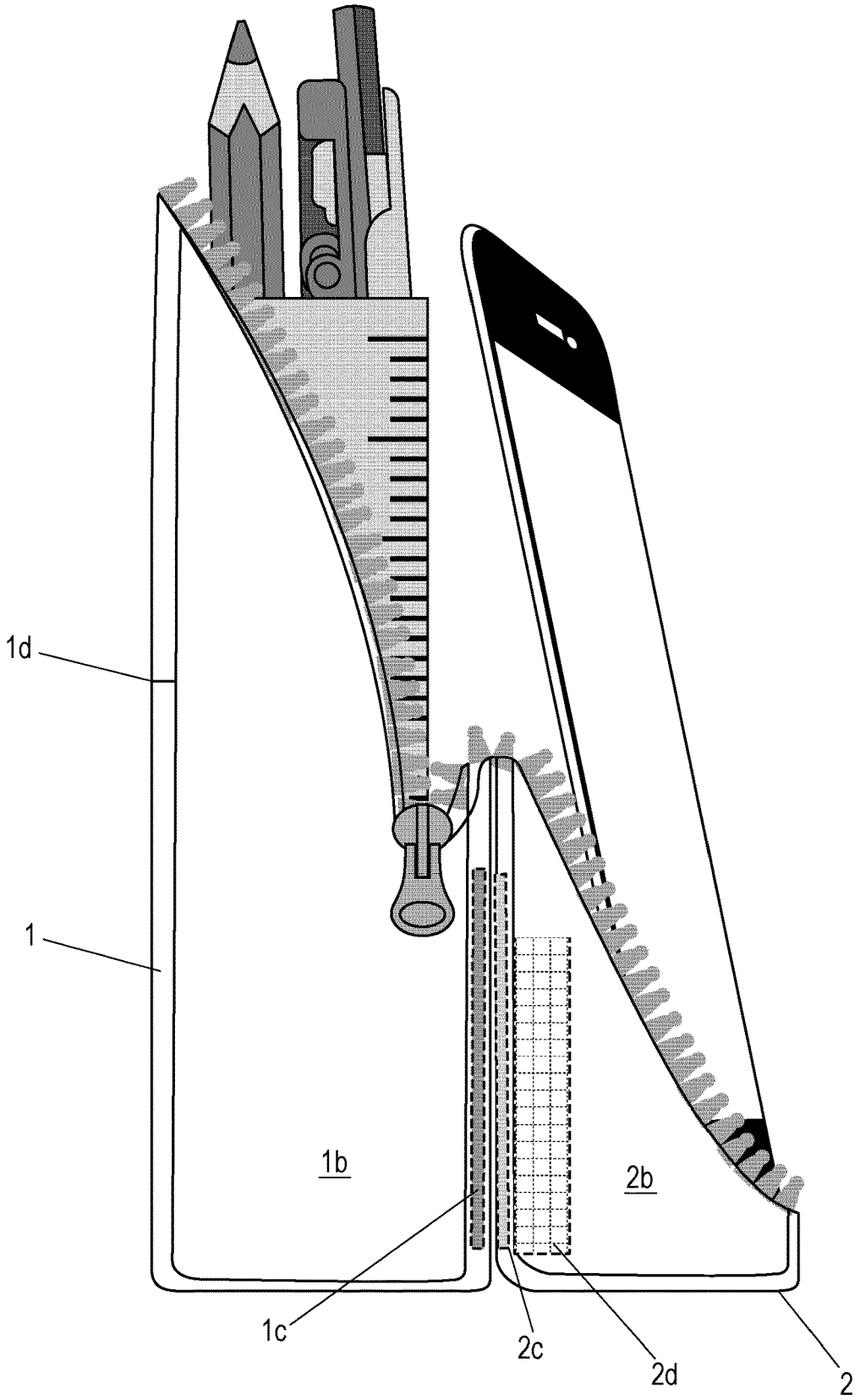
FIG. 3 illustrates a view of a use example of the self-standing housing body of the present invention.

Next, the use example of the pen case will be described with reference to FIGS. 3 and 4.

The fasteners 1*a*, 2*a* as the opening/closing units are opened from the closed state of FIG. 1, and about the joint portion 3 as the rotation axis, the lid portion 2 is rotated approximately 180°. Then, one side surface of the housing portion 1 comes into contact with one side surface of the lid portion 2. Then, the housing portion 1 and the lid portion 2 are firmly fixed to each other by the side portion fixing units 1*c*, 2*c*. When the pen case is placed on, e.g., a desk in such a state, the pen case can be used as the penholder as illustrated in FIG. 3. Both of the bottom surface 1*e* of the housing portion 1 and the upper surface 2*e* of the lid portion 2 serve as contact surfaces, and therefore, a placement area can be doubled and extremely-stable placement can be realized.

Moreover, the lid-portion-2-side surface of the housing portion 1 is positioned lower, and therefore, the storage object such as a writing material or a ruler can be easily taken out. As described above, the housing portion 1 opens not only on an upper side but also on a lateral side, and therefore, an opening area is increased and convenience as the penholder is improved.

Further, the inside of the lid portion 2 can be utilized for multiple purposes as the sub-housing space 2*b*. In FIG. 3, the sub-housing space 2*b* is utilized as a smartphone stand by way of example. With an opening for passage of a cord at the side surface of the lid portion 2, convenience as the smartphone stand is further improved.

The sub-housing space 2*b* is, other than the smartphone stand, also optimal as a housing space for placing the small object such as the eraser. An easy access to the small object can be made without the need for inserting a finger into the housing portion 1. Moreover, the pocket 2*d* can be also utilized for housing the small object.

The lid portion can be separately used as the sub-housing space 2*b* as described above because it is configured such that the upper end portion of the side surface of the housing portion does not reach the upper surface. With this configuration, the lid portion is in the form of a container in the standing state, and the small object and the like can be housed.

Moreover, since the lid portion is in the form of the container, stiffness of a standing portion of the lid portion is high, a self-standing posture as a pen stand is stabilized, and falling and tilting are less caused.

Further, upon opening/closing, an opening/closing distance is short, and opening/closing operation is promptly performed.

As described above, many features are provided by the configuration in which the lid portion 2 is folded back 180°. An increase in the placement area, an increase in the opening area of the housing portion 1, multipurpose utilization of the sub-housing space 2*b* as the inside of the lid portion 2, and placement of the pocket 2*d* are also allowed.

Figure 4:
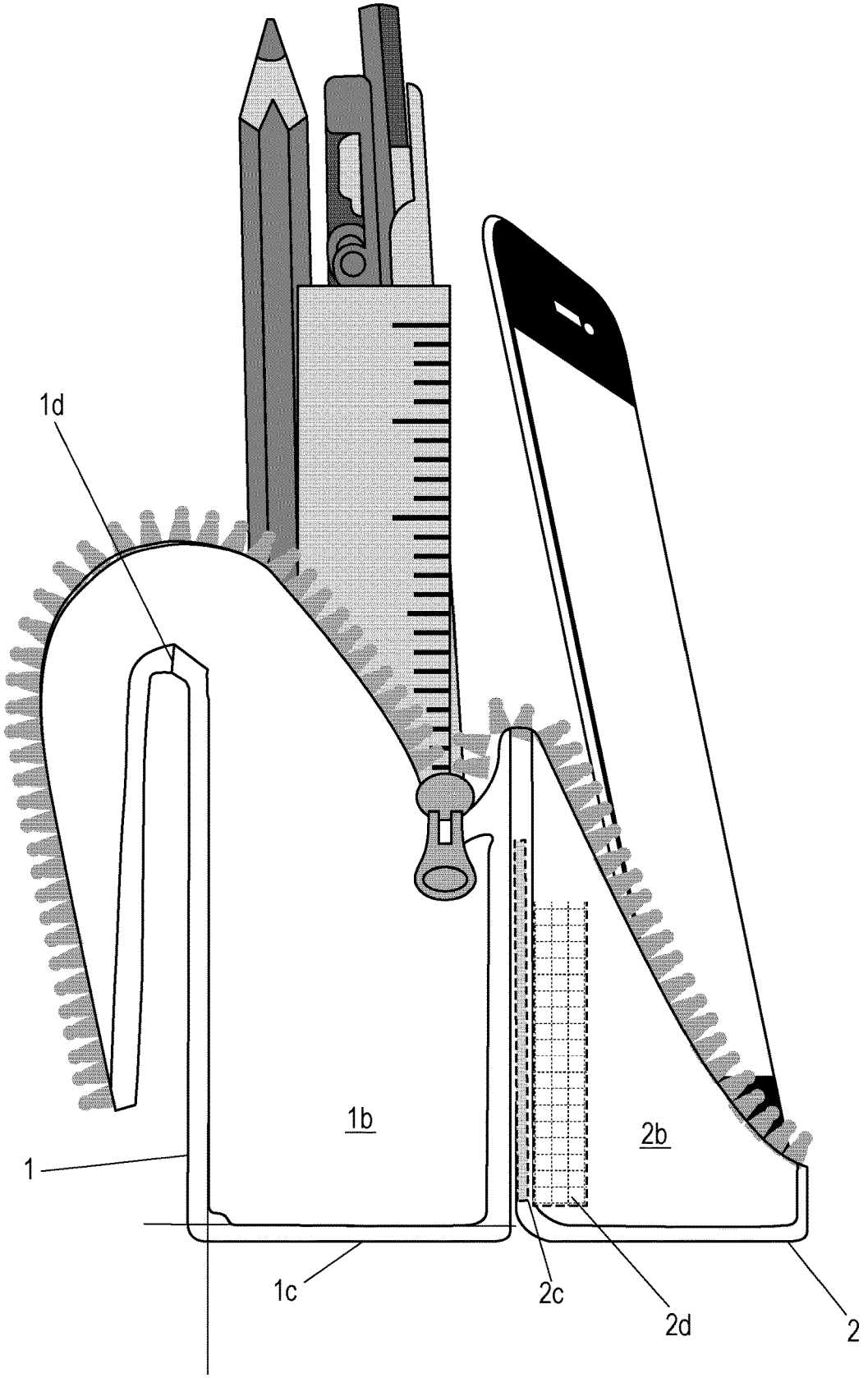
FIG. 4 illustrates a view of the use example of the self-standing housing body of the present invention when a housing portion is bent.

FIG. 4 is a view of the method for utilizing the bendable portion 1*d* provided at the housing portion 1. For example, the bendable portion 1*d* can be realized in such a manner that a folding line (a recessed portion) is provided at the material forming the housing portion 1. As in FIG. 4, a portion above the bendable portion 1*d* is folded back to a bottom surface 1*e* side, and therefore, the storage object in the housing portion 1 can be easily taken out from any direction of 360°.

Summary of Present Invention

The self-standing pen case according to the present invention is configured such that the lid portion is folded back 180°, and therefore, many advantageous effects of the invention as described below are provided.

First, a housing capacity does not change between a state in which the pen case is closed and a state in which the pen case is opened in the standing state, and therefore, even when many writing materials are housed in the opened standing state, the pen case can be closed in such a state and be carried.

Moreover, a lid opening/closing mechanism similar to that of a typical pen case is employed. Thus, a complicated mechanism is not necessary, a manufacturing cost does not increase, and the housing capacity does not decrease due to the opening/closing mechanism.

Further, the placement area is doubled in a state in which the pen case is opened in the standing state, and therefore, the pen case can be used as the extremely-stable standing penholder. In recent years, a high-texture pen case providing a tender impression and formed by fabric sewing has been popular. Even when such a soft material is used, the placement area is broad, and therefore, stable standing can be realized.

In addition, the height position of the joint portion between the housing portion and the lid portion is at the substantially center position of the height when the pen case is closed. The lid portion is, about the joint portion as the axis, rotated relative to the housing portion and stands, and therefore, the height of the side surface of the housing portion including the joint portion is, in the standing state, at the substantially-half position of the height in the closed state. Thus, the storage object is easily taken out.

Specifically, when the height position of the end portion of the opening/closing unit is provided closer to the bottom surface than the height position of the joint portion is to, the height of the side surface of the housing portion including the joint portion becomes much lower, and the storage object is more easily taken out. Moreover, the storage object is less caught by the lid portion upon opening/closing of the lid portion, and opening/closing of the lid portion is smoothly performed.

Further, the lid portion can be separately used as the housing portion in the standing state, and therefore, use application is greatly expanded to various purposes. For example, the small object which is difficult to be taken out, such as the eraser or the clip, can be placed in the housing portion of the lid portion, and the housing portion of the lid portion can be utilized as the smartphone stand.

As described above, the lid portion can be separately used as the housing portion because it is configured such that the upper end portion of the side surface of the housing portion does not reach the upper surface. With this configuration, the lid portion is in the form of the container in the standing state, and the small object and the like can be housed.

Moreover, since the lid portion is in the form of the container, the stiffness of the standing portion of the lid portion is high, the self-standing posture as the pen stand is stabilized, and falling and tilting are less caused.

Further, upon opening/closing, the opening/closing distance is short, and the opening/closing operation is promptly performed.

In addition, the pocket for the small object can be provided on the inside of the lid portion, and therefore, the small object which is difficult to be taken out, such as the eraser or the clip, can be more easily taken out in the standing state.

Moreover, the side portion fixing unit such as the magnet allows, in the closed state, storage of the pen case with the pen case being attached to, e.g., a wall surface of a steel locker. For example, a narrow space of the locker can be effectively utilized.

Similar advantageous effects are also provided when the present invention is used as the self-standing makeup pouch.

Specifically, it is convenient upon makeup at a narrow space such as a makeup room outside a home. The self-standing makeup pouch is used, and therefore, easy placement even in a narrow space is realized and an elongated object such as a brush, an eyelash liner, or an eye shadow is easily taken out. Moreover, the lid portion can be separately used as the housing portion, and therefore, functional use for makeup, such as standing of a small mirror or placement of a short lip stick or a short chapstick, can be realized.

Second Embodiment

In the first embodiment, the self-standing pen case in a semicircular columnar shape in the closed state has been described. However, the shape of the self-standing pen case is not limited to the semicircular columnar shape in the closed state, and various shapes can be employed.

Figure 5:
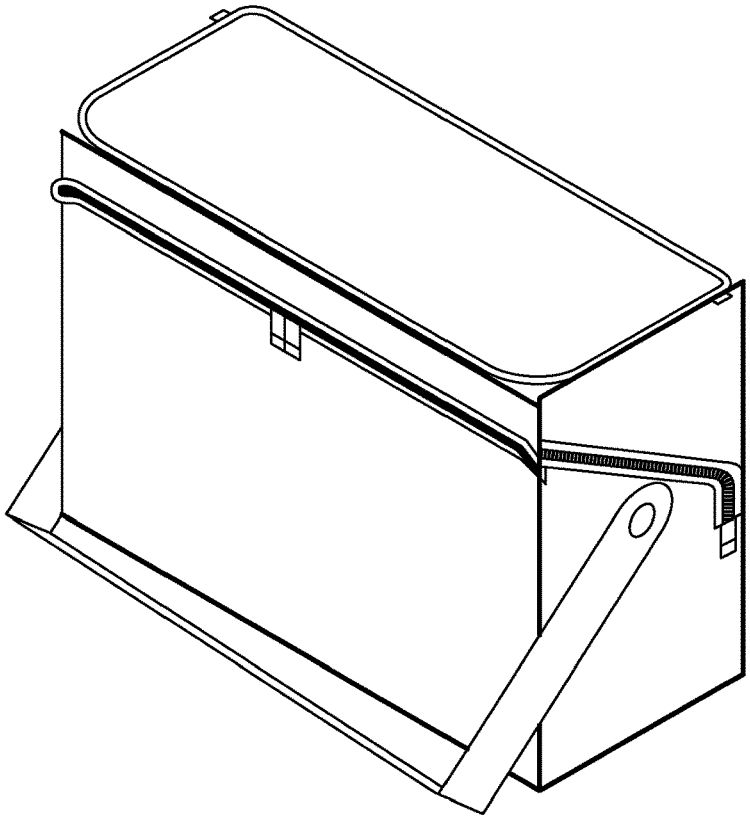
FIG. 5 illustrates perspective views of a box-shaped self-standing housing body in a second embodiment, FIG. 5 illustrating (a) a closed state and (b) an opened standing state.
Figure 5:
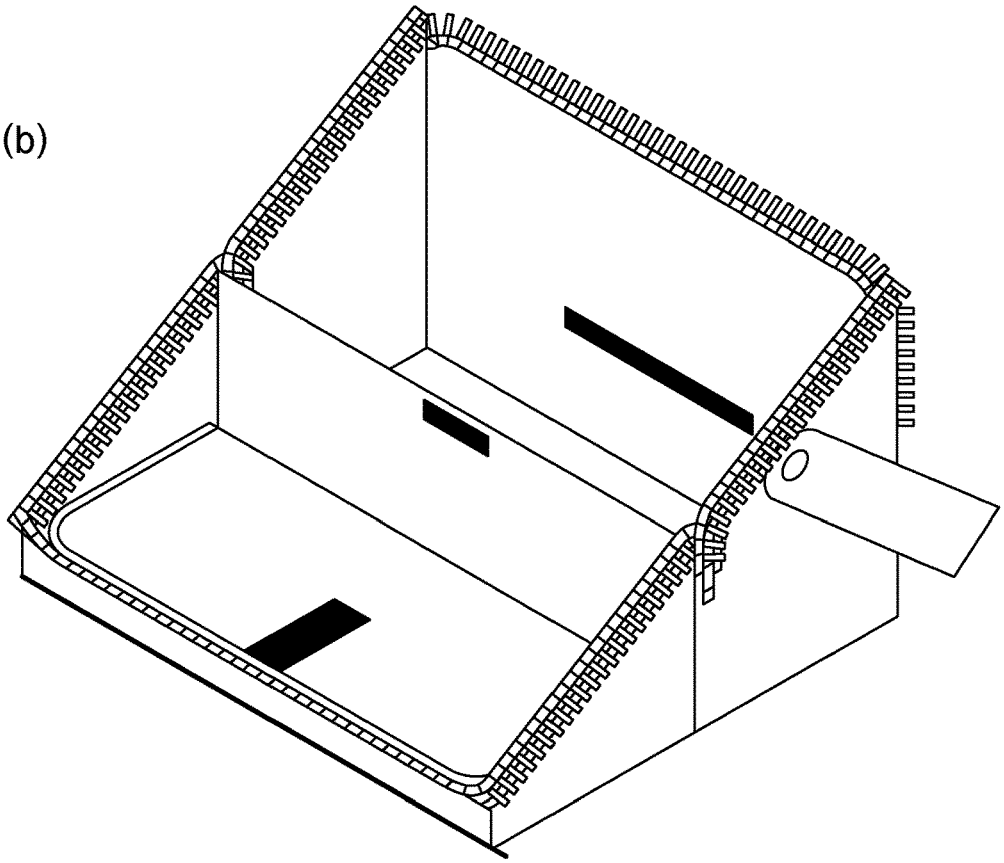
Figure 6:
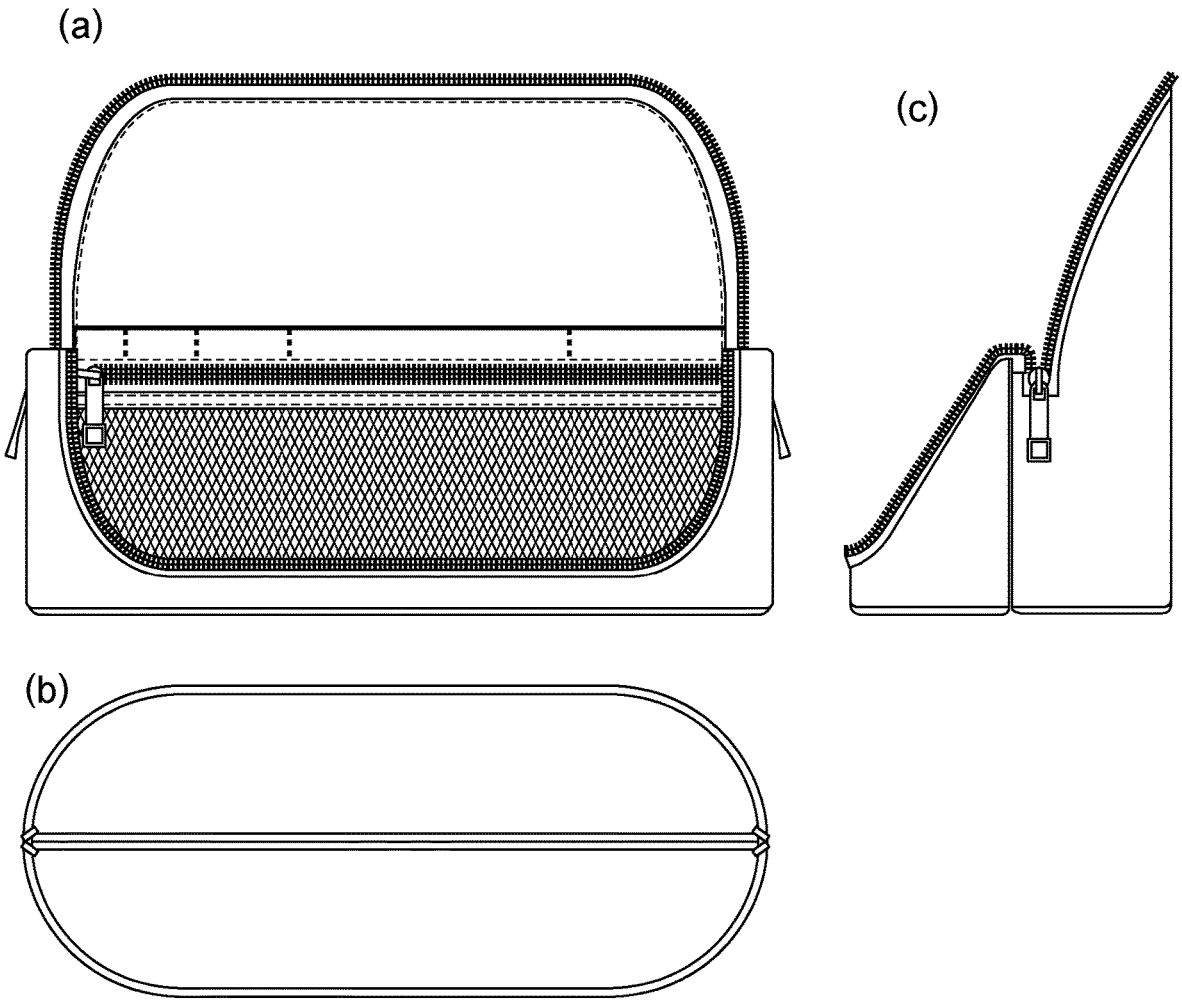
FIG. 6 illustrates a three-dimensional view in a state in which a self-standing housing body in a horizontally-elongated semicircular shape is opened in a standing state in the second embodiment, FIG. 6 illustrating (a) a front view, (b) a bottom view, and (c) a side view.
Figure 7:
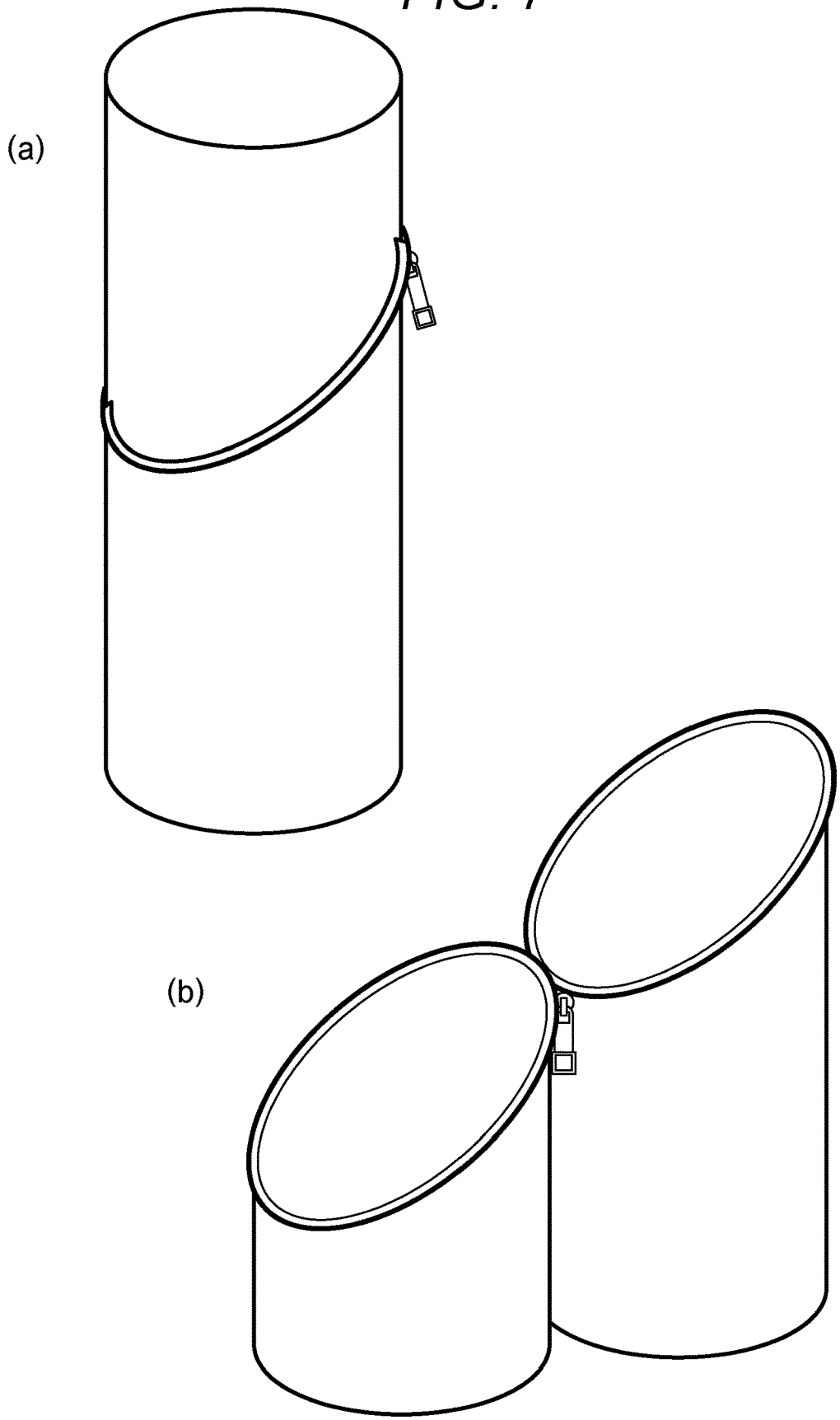
FIG. 7 illustrates perspective views of a circular columnar self-standing housing body in the second embodiment, FIG. 7 illustrating (a) a closed state and (b) an opened standing state.
Figure 8:
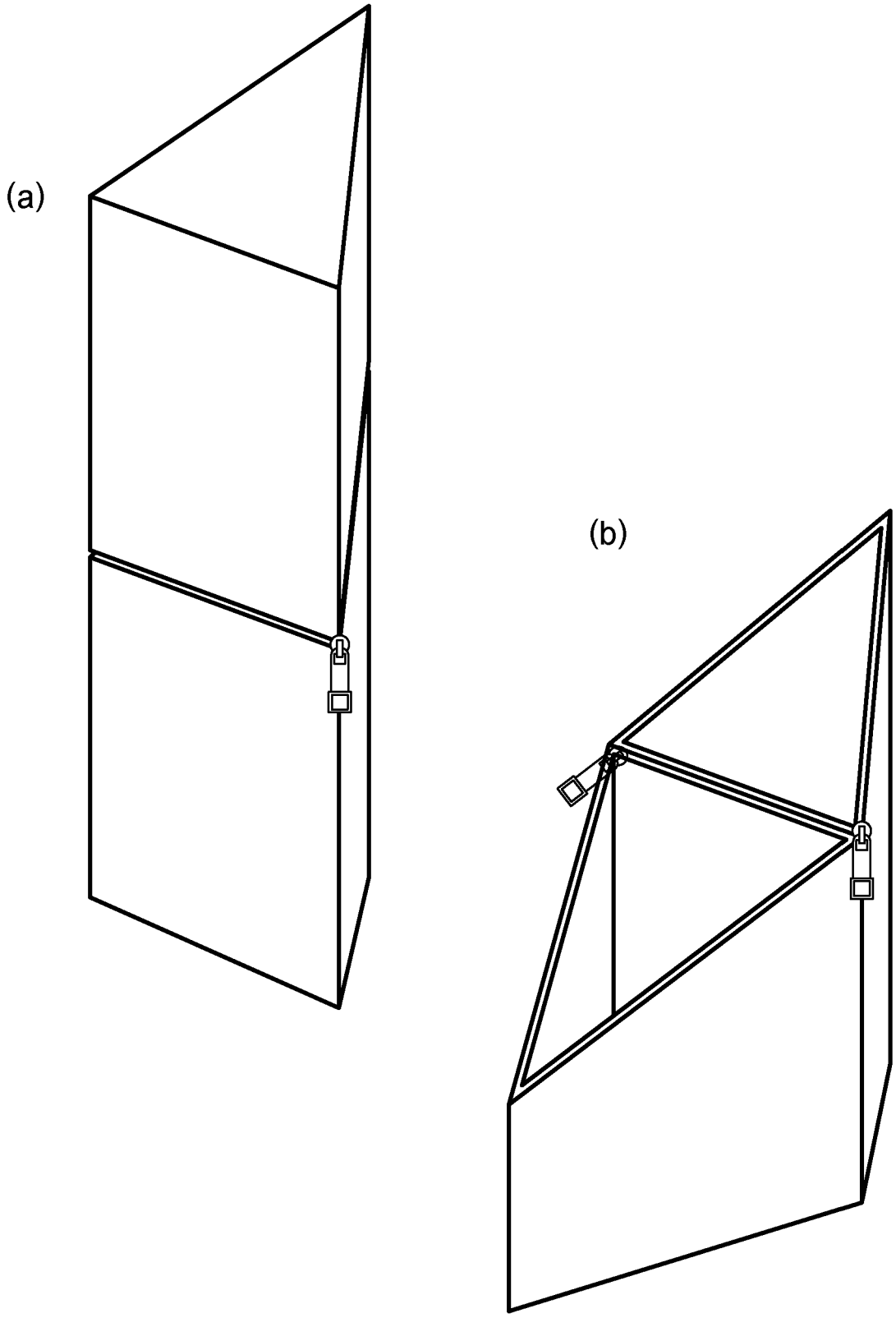
FIG. 8 illustrates perspective views of a triangular columnar self-standing housing body in the second embodiment, FIG. 8 illustrating (a) a closed state and (b) an opened standing state.

For example, a box shape illustrated in FIG. 5, a horizontally-elongated semicircular shape illustrated in FIG. 6, a circular columnar shape illustrated in FIG. 7, and a triangular prism shape illustrated in FIG. 8 can be employed.

That is, any shape may be employed as long as the self-standing pen case including the housing portion having the main housing space surrounded by the bottom surface and the side surfaces standing from the bottom surface and the lid portion having the sub-housing space surrounded by the upper surface and the side surfaces standing from the upper surface is configured such that part of the upper end portion of the side surface of the housing portion and part of the lower end portion of the side surface of the lid portion form the joint portion, the lid portion is, about the joint portion as the substantially rotation axis, rotatably joined to the housing portion, the upper surface of the lid portion and the bottom surface of the housing portion are substantially flush with each other when the lid portion is rotated approximately 180° relative to the housing portion and the side surface of the lid portion substantially contacts the side surface of the housing portion, and the upper end portion of the side surface of the housing portion does not reach the upper surface. Moreover, in any shape, advantageous effects of the invention similar to those of the pen case described in the first embodiment are provided.

Moreover, in the box shape illustrated in FIG. 5, an inner capacity is great, and a housing amount is great. Further, in a standing state as a pen stand, a placement area is large, and self-standing stability is improved.

Even in the horizontally-elongated semicircular shape illustrated in FIG. 6, features similar to those of the box shape illustrated in FIG. 5 as described above are provided. Moreover, a use method as a desktop organizer is also allowed.

Further, in the circular columnar shape illustrated in FIG. 7, features similar to those of the box shape illustrated in FIG. 5 as described above are provided.

LIST OF REFERENCE NUMERALS

1 Housing portion
1*a* Opening/closing unit
1*b* Main housing space
1*c* Side portion fixing unit
1*d* Bendable portion
1*e* Bottom surface
2 Lid portion
2*a* Opening/closing unit
2*b* Sub-housing space
2*c* Side portion fixing unit
2*d* Pocket
2*e* Upper surface
3 Joint portion

The invention claimed is:

1. A self-standing housing body comprising:

a housing portion having a main housing space surrounded by a bottom surface and a side surface standing from the bottom surface;

a lid portion having a sub-housing space surrounded by an upper surface and a side surface standing from the upper surface; and an opening/closing unit configured to detachably open/close the housing portion and the lid portion, wherein a height position of an end portion of the opening/closing unit is provided closer to the bottom surface than a height position of a joint portion is to, part of an upper end portion of the side surface of the housing portion and part of a lower end portion of the side surface of the lid portion form the joint portion, and about the joint portion as a substantially rotation axis, the lid portion is rotatably joined to the housing portion, when the lid portion is rotated approximately 180° relative to the housing portion and the side surface of the lid portion substantially contacts the side surface of the housing portion, the upper surface of the lid portion and the bottom surface of the housing portion are substantially flush with each other, the upper end portion of the side surface of the housing portion does not reach the upper surface of the lid, and at the housing portion, a bendable portion allowing an upper portion of a side surface facing a side surface having the joint portion to bend to a direction of the bottom surface.

2. The self-standing housing body according to claim 1, wherein the self-standing housing body is a self-standing pen case.

3. A self-standing housing body comprising:

a housing portion having a main housing space surrounded by a bottom surface and a side surface standing from the bottom surface;

a lid portion having a sub-housing space surrounded by an upper surface and a side surface standing from the upper surface;

an opening/closing unit configured to detachably open/close the housing portion and the lid portion, and a side portion fixing unit configured to detachably fix the side surface of the lid portion and the side surface of the housing portion contacting each other when the lid portion is rotated approximately 180° relative to the housing portion, wherein a height position of an end portion of the opening/closing unit is provided closer to the bottom surface than a height position of a joint portion is to, part of an upper end portion of the side surface of the housing portion and part of a lower end portion of the side surface of the lid portion form the joint portion, and about the joint portion as a substantially rotation axis, the lid portion is rotatably joined to the housing portion, when the lid portion is rotated approximately 180° relative to the housing portion and the side surface of the lid portion substantially contacts the side surface of the housing portion, the upper surface of the lid portion and the bottom surface of the housing portion are substantially flush with each other, and the upper end portion of the side surface of the housing portion does not reach the upper surface of the lid.

4. The self-standing housing body according to claim 3, wherein the side portion fixing unit uses magnetic interaction.

5. The self-standing housing body according to claim 3, wherein the self-standing housing body is a self-standing pen case.

* * * * *